US011223146B2

(12) United States Patent
Maser

(10) Patent No.: US 11,223,146 B2
(45) Date of Patent: Jan. 11, 2022

(54) ELECTRICAL CONTACT SYSTEM

(71) Applicant: Otto Maser, El Paso, TX (US)

(72) Inventor: Otto Maser, El Paso, TX (US)

( * ) Notice: Subject to any disclaimer, the term of this patent is extended or adjusted under 35 U.S.C. 154(b) by 0 days.

(21) Appl. No.: 16/829,568

(22) Filed: Mar. 25, 2020

(65) Prior Publication Data

US 2021/0151918 A1 May 20, 2021

Related U.S. Application Data

(60) Provisional application No. 62/937,984, filed on Nov. 20, 2019.

(51) Int. Cl.
*H01H 36/00* (2006.01)
*H01R 12/72* (2011.01)
*H01R 13/641* (2006.01)

(52) U.S. Cl.
CPC ..... *H01R 12/727* (2013.01); *H01H 36/0033* (2013.01); *H01R 13/641* (2013.01)

(58) Field of Classification Search
CPC ..... H01R 12/727; H01H 36/0033
USPC ..... 335/93, 151, 154, 235
See application file for complete search history.

(56) References Cited

U.S. PATENT DOCUMENTS 3,544,934 A * 12/1970 Poliakoff ..... H01H 36/0033 335/206
3,668,579 A * 6/1972 Harman ..... G08B 13/08 335/207
3,771,083 A 11/1973 Wessel
4,170,005 A * 10/1979 Duke ..... G08B 13/08 335/206
4,210,889 A * 7/1980 Holce ..... H01H 36/0026 335/206
4,258,346 A * 3/1981 Williams ..... H01H 36/0066 335/206
4,943,791 A 7/1990 Holce et al.
4,945,340 A * 7/1990 Brill ..... G08B 13/08 335/206
5,239,202 A * 8/1993 Hostetler ..... H01H 36/0046 307/116
5,633,626 A * 5/1997 Cawthorne ..... G08B 13/08 335/206
5,723,835 A 3/1998 Gilmore
6,100,608 A * 8/2000 Takahashi ..... H01H 36/0033 307/125
6,963,281 B2 * 11/2005 Buckley ..... G08B 13/08 335/206
7,164,335 B2 * 1/2007 Forsythe ..... H01H 15/06 335/151
2005/0151608 A1 7/2005 Wieger et al.
2007/0279165 A1 12/2007 Gilmore

* cited by examiner

*Primary Examiner* — Alexander Talpalatski
(74) *Attorney, Agent, or Firm* — Boudwin Intellectual Property; Daniel Boudwin

(57) ABSTRACT

An electrical contact system is shown and described. The electrical contact system includes a housing. The housing includes a plurality of sidewalk and a top section having an interior volume. A circuit board is secured within the interior volume the circuit board has a plurality of traces located thereon. Each trace has a plurality of lands connected thereto. A plurality of electrical contacts is electrically connected to the lands such that one end of the electrical contact is connection to one trace and the second end of the electrical contact is connected to the second trace.

20 Claims, 4 Drawing Sheets

ELECTRICAL CONTACT SYSTEM

CROSS REFERENCE TO RELATED APPLICATIONS

This application claims the benefit of U.S. Provisional Application No. 62/937,984 filed on Nov. 20, 2019. The above identified patent application is herein incorporated by reference in its entirety to provide continuity of disclosure.

BACKGROUND OF THE INVENTION

The present invention relates to electrical switches and contacts. More particularly, the present invention provides an improved system for electrical contacts that prevents false contacts from producing unwanted results.

There are many different systems that require electrical contact switches known as reed switches. Overhead and roll-up doors for example use these switches in the activation of the door sensor. Other systems such as security systems may use these contacts for sensors. Traditionally, these sensors only include one reed switch.

These contacts can produce false positive results if rattled or bumped. A false positive could result in a garage door indicating open when it should not be. If the garage door, for example is closed but reads as open. In other instances, alarm systems may give false alarm warnings if a sensor is bumped or misaligned.

Some alarm systems employ a two-part sensor. The first part of the sensor is typically a stationary sensor attached to a wall or frame near a door or window. The second part of the sensor is typically attached to the door or window itself. When the two parts of the sensor are placed in close proximity, the switch is completed. Some alarms systems employ a reed switch which is held in a closed position by a magnet located in one part of the sensor. This configuration, however, leads to false positive results. Due to the nature of magnetic fields there is a weak spot in the field and stronger areas on the edges of the magnet. Consequently, if the two parts of the reed switch are not correctly lined up with the magnetic field, the circuit may be completed or broken resulting in the sensor signaling that a door or window is opened when it is in fact closed. If either part of the sensor or door is bumped and/or becomes misaligned, the electrical contact can complete or break the circuit respectively. The misalignment will then result in a false positive alert.

Consequently, there is a need in for an improvement in the art of electrical contacts. The present invention substantially diverges in design elements from the known art while at the same time solves a problem many systems and people face when using electrical contacts for switches or notifications. In this regard the present invention substantially fulfills these needs.

SUMMARY OF THE INVENTION

The present invention provides an improved electrical contact system wherein the same can be utilized for providing convenience for the user when using an electrical system for switches or notifications. The improved electrical contact system comprises a housing having an interior volume. A circuit board located within the interior volume wherein the circuit board has a plurality of wire connections thereon. A plurality of electrical contacts electrically connected to the wire connections.

Another object of the improved electrical contact system is to provide a failsafe system. The system includes multiple electrical contacts for the purpose of having a reed switch fill the gaps or bad spot created by the magnetic field. This may be achieved in a number of ways and all are contemplated by way of this disclosure. In one contemplation there are a number of reed switches secured within one housing which accomplishes the goal as set forth. Two or more magnetic reed switches in one housing are provided for the purpose of maintaining electrical contact with one or more switches at any time that a magnet is present to secure proper electrical contant.

Another object of the improved electrical contact system is to have an electrical contact activation device located within the housing.

Another object of the improved electrical contact system is to have a second housing having an interior volume. The interior volume houses an electrical contact activation device located within the housing, wherein the second housing is located adjacent to the first housing.

Another object of the improved electrical contact system is to have the electrical contact activation device be a magnet.

Another object of the improved electrical contact system is to have there are 5 electrical contacts.

Another object of the improved electrical contact system is to have the electrical contacts be reed switches.

Another object of the improved electrical contact system is to have the electrical contacts be arranged in an alternating configuration.

Another object of the improved electrical contact system is to have the electrical contacts attached in a parallel circuit.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
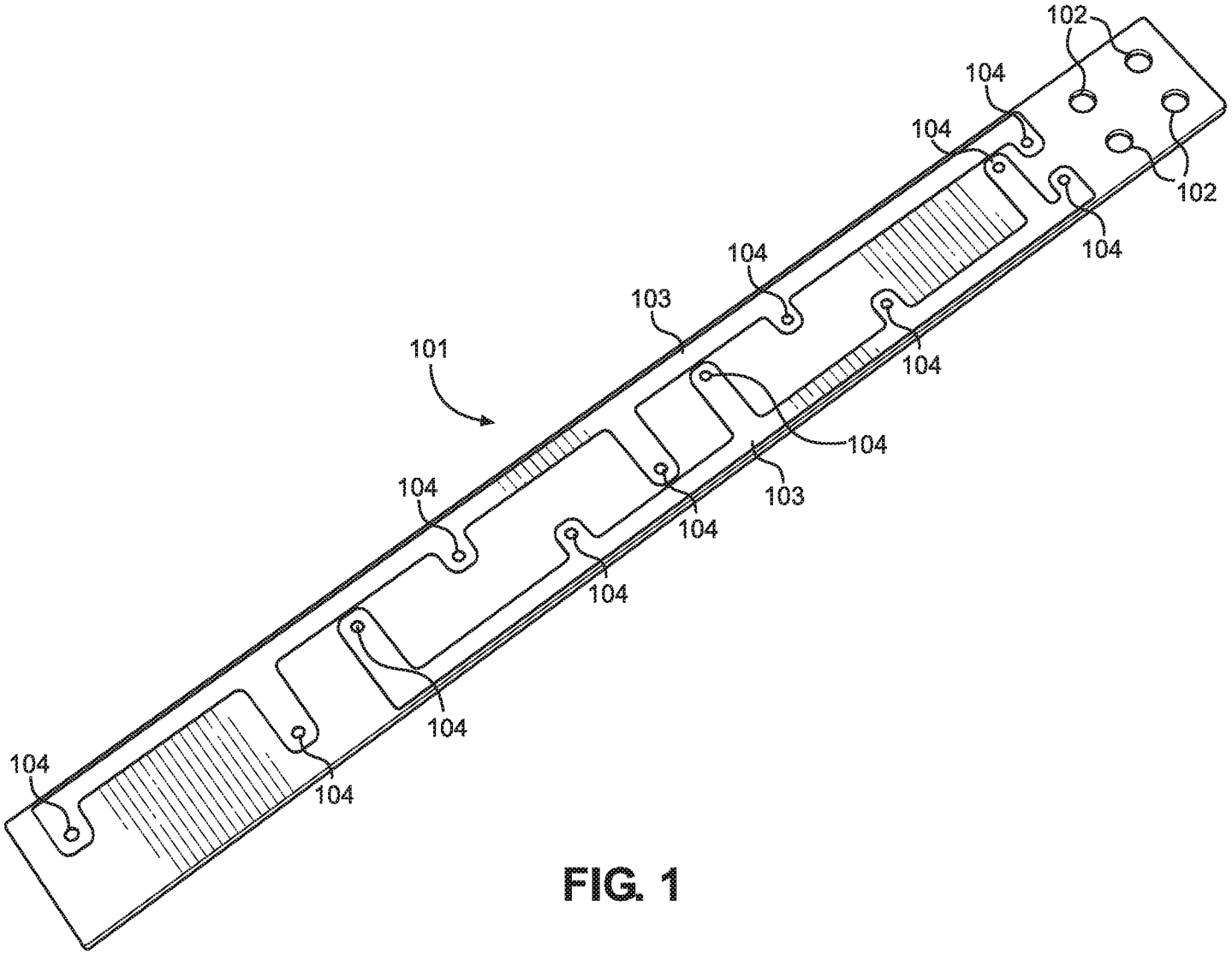
FIG. 1 shows a perspective view and embodiment of the circuit board for the improved electrical contact system.

Reference is made herein to the attached drawings. Like reference numerals are used throughout the drawings to depict like or similar elements of the improved electrical contact system. For the purposes of presenting a brief and clear description of the present invention, a preferred embodiment will be discussed as used for the improved electrical contact system. The figures are intended for representative purposes only and should not be considered to be limiting in any respect.

Referring now to FIG. 1, there is shown a perspective view and embodiment of the circuit board for the improved electrical contact system. The improved electrical contact system is comprised of a circuit board 101. One of ordinary skill in the art will understand that the circuit board provides a medium on which pathways for electrical current to flow resulting in the completion or breakage of a circuit. In one embodiment the circuit board 101 is made from fiberglass. In another embodiment the circuit board 101 is made using an aluminum printing technique.

The circuit board 101 has at least one connection aperture 102 located through the circuit board 101. In the shown embodiment, there are four connection apertures 102 located at one terminal end of the circuit board 101. However, it is contemplated by this disclosure that any number of connection apertures may be present. In another embodiment, there are connection apertures 102 located at each end of the circuit board 101. The connection apertures are configured to pass wires through to prevent them from being pulled from the circuit.

The circuit board 101 further has two traces 103 located on one side thereon. Each trace 103 has a plurality of lands 104 electrically connected to the traces 103. In one embodiment the traces 103 are made from copper. In one embodiment a trace 103 is configured to run along an edge of the circuit board 101 and a second trace 103 is configured to run along an opposite edge of the circuit board 101. In one embodiment there is a land 104 at the end of each trace 104. There are further various lands 104 located along the circuit board. In one embodiment the lands 104 are located such that electrical contacts as described below are connected to the lands 104 parallel to the traces 103. On an embodiment the lands are positioned such that the electrical contacts are able to overlap. This will reduce the length of the circuit board 101. In another embodiment, the lands are positioned such that the electrical contacts are attached to the lands 104 at an angle respective to the traces 103. Different angles of the electrical contacts will have different impacts on the electrical contacts as described below.

Figure 2:
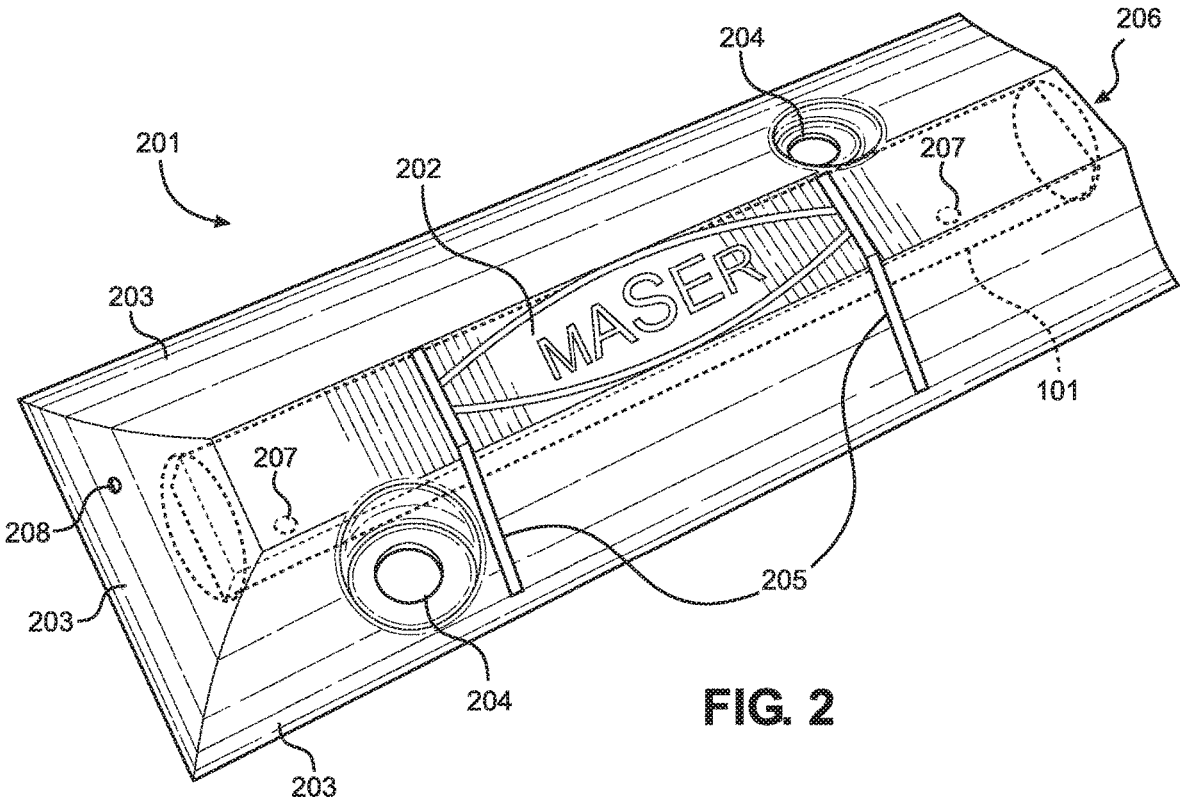
FIG. 2 shows a perspective view of an embodiment for a casing for the improved electrical contact system.

Referring now to FIG. 2, there is shown a perspective view of an embodiment for a casing for the improved electrical contact system. In one embodiment the circuit board is configured to fit within a housing 201. In one embodiment the housing 201 forms one part of a contact sensor. In the shown embodiment the housing 201 includes a top face 202 connected to a plurality of sidewalk 203. In one embodiment the sidewalls 203 are straight. In another embodiment the sidewalk 203 are tapered. In a further embodiment the housing 201 further has at least one connection aperture 204. In the shown embodiment there are two connection apertures 204. The connection apertures 204 are configured to allow for fasteners to be placed therethrough and for the housing to be attached to a surface.

In one embodiment there is a circuit board hole 206 located at one end of the housing 201. The circuit board hole 206 is proportioned to allow the circuit board 101 to therein. The circuit board hole 206 is proportioned to snuggly fit the circuit board 101. This will prevent the circuit board 101 from moving and becoming damaged. In one embodiment the circuit board 101 is secured within the housing 201 using epoxy. In one embodiment the epoxy is placed into epoxy holes 207. The epoxy will secure the circuit within the housing.

In a further embodiment there are fail safes built into the housing. In one embodiment a light 208 is added to the housing. In one embodiment 208 is an LED light. The light 208 is connected to the circuit board 101. In one embodiment the housing 201 further includes a pair of edge markers 205. The edge markers 205 will allow for proper placement of the electrical contact activation device as described in FIG. 8.

Figure 3:
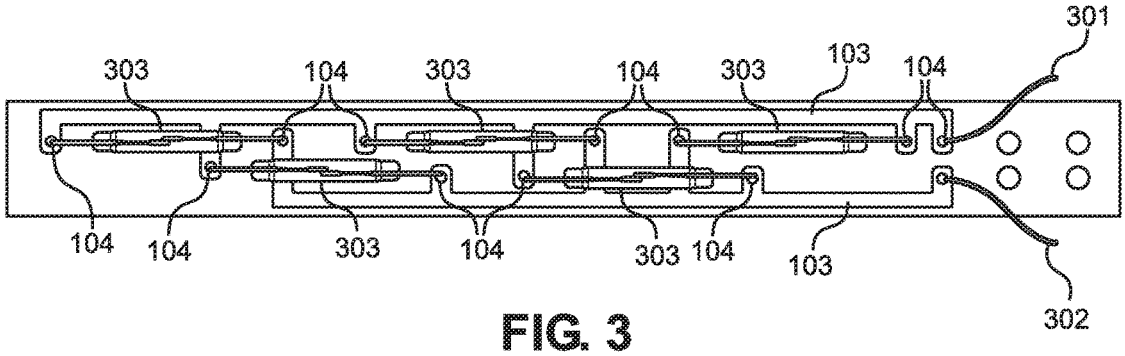
FIG. 3 shows a perspective view of an embodiment of electrical contacts installed on the improved electrical contact system.

Referring now to FIG. 3, there is shown a perspective view of an embodiment of electrical contacts installed on the improved electrical contact system. The circuit has lead wires 301, 302 attached to a land 104 on each trace 103. One lead wire 301 is a hot wire while the other lead wire 302 is the neutral wire. This will allow electricity to flow through the circuit board 101. A plurality of electrical contacts 303 are connected to the lands 104. In one embodiment the electrical contacts 303 are connected in parallel. In another embodiment the electrical contacts 303 are connected in series. The electrical contacts 303 are connected such that one end of each electrical contact 303 is connected to one trace 103 and the other end of each electrical contact is connected to the opposite trace 103. In the shown embodiment the electrical contacts 303 are reed switches. In the shown embodiment the electrical contacts 303 are shown to overlap each other in a parallel fashion.

Figure 4:
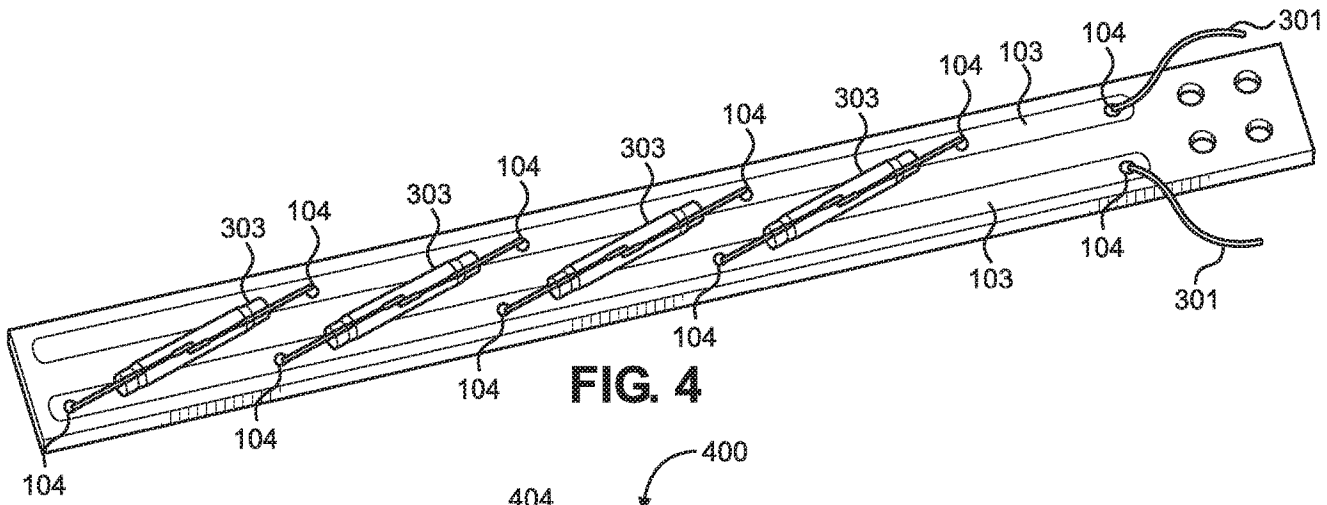
FIG. 4 shows a perspective view of an alternative embodiment of electrical contacts installed on the improved electrical contact system.

Referring now to FIG. 4, there is shown a perspective view of an alternative embodiment of electrical contacts installed on the improved electrical contact system. The circuit has lead wires 301, 302 attached to a land 104 on each trace 103. One lead wire 301 is a hot wire while the other lead wire 302 is the neutral wire. This will allow electricity to flow through the circuit board 101. A plurality of electrical contacts 303 are connected to the lands 104. In one embodiment the electrical contacts 303 are connected in parallel. In another embodiment the electrical contacts 303 are connected in series. The electrical contacts 303 are connected such that one end of each electrical contact 303 is connected to one trace 103 and the other end of each electrical contact is connected to the opposite trace 103. In the shown embodiment the electrical contacts 303 are reed switches.

In the shown embodiment the electrical contacts 303 are connected such that they do not overlap each other. In the shown embodiment the electrical contacts 303 are connected to the lands 104 of each trace 103 such that each electrical contact 303 is connected to both traces 103. In the shown embodiment the electrical contacts 303 are located on an angle. In another embodiment the electrical contacts 303 could be on a greater or lesser angle. In another embodiment the electrical contacts 303 are perpendicular to the traces 103.

Figure 5:
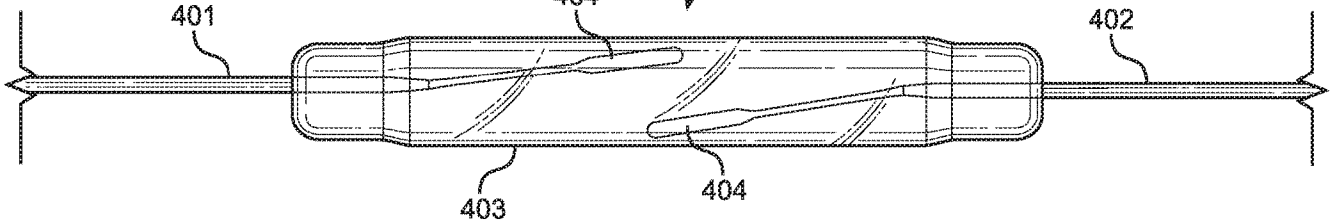
FIG. 5 shows a perspective view of an embodiment of an opened electrical contact.
Figure 6:
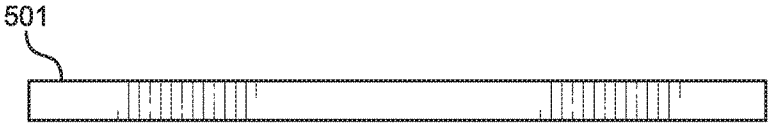
FIG. 6 shows a perspective view of an embodiment of a closed electrical contact and a magnet.
Figure 6:
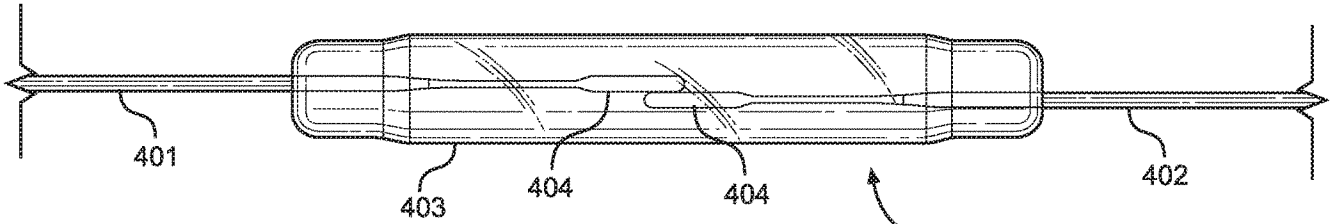

Referring now to FIG. 5 and FIG. 6, there is shown a perspective view of an embodiment of an electrical contact and a magnet holding the electrical contact closed. The figures show an example of a reed switch 400 which is an embodiment of the electrical contacts used. In the shown example, the reed switch 400 includes a first connection end 401 and a second connection end 402. The connection ends 401, 402 are configured to attach to lands of a circuit. The connection ends 401, 402 enter a housing 403. The housing 403 having an interior volume. In one embodiment the housing is glass. In another embodiment the housing 403 is plastic. There are contacts 404 located within the housing 403. One contact 404 is connected to the first connection 401 end, and another contact 404 is connected to the second connection end 402.

In the shown embodiment the contacts are naturally separated. In other embodiments the contacts 404 are naturally together. In both embodiments the contacts are configured to be operated upon by a magnet 501. When a magnet 501 is placed within a specific range of the reed switch 400 the contacts 404 will come together completing the circuit. In other embodiments when a magnet 501 is placed within a specific range of the reed switch 400 the contacts 404 will separate, breaking the circuit.

Figure 7:
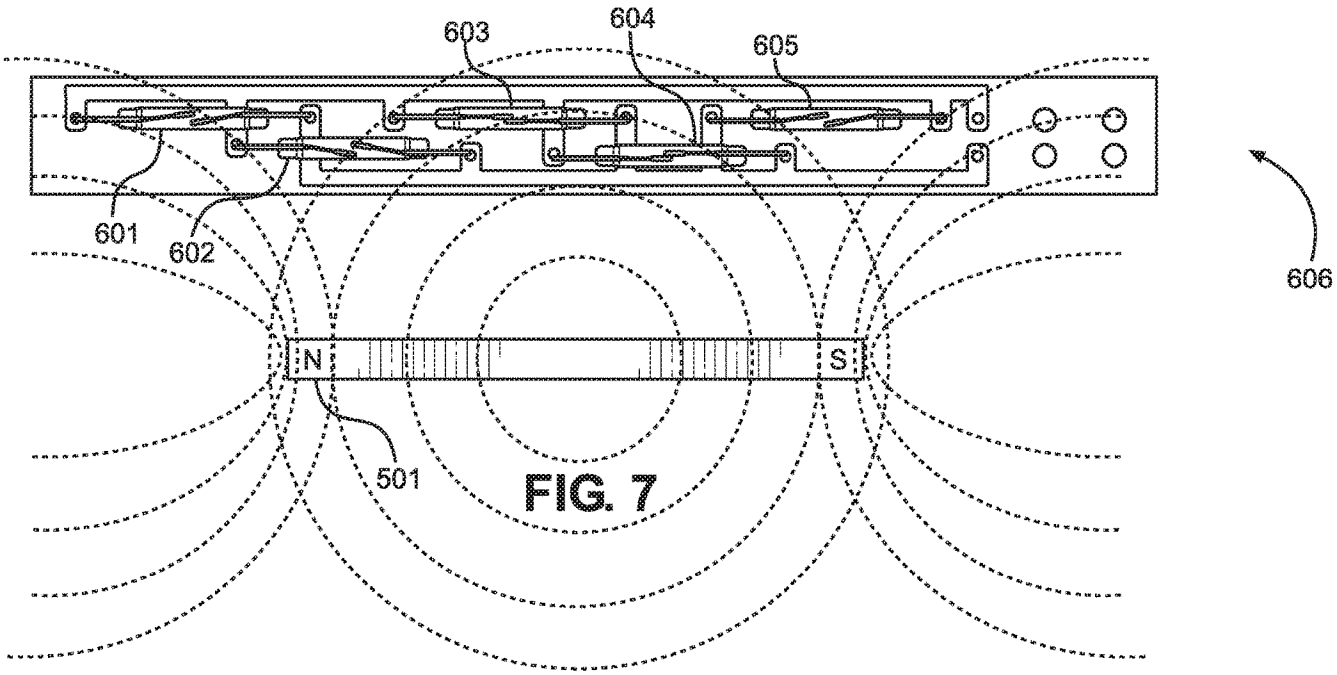
FIG. 7 shows a perspective view of an embodiment of the improved electrical contact circuit and a magnet.

Referring now to FIG. 7, there is shown a perspective view of an embodiment of the improved electrical contact circuit and a magnet. In some uses the magnet 501 has a magnetic field 606 of varying strengths across the length of the magnet 501. The magnetic field creates a FIG. 8 due to the polarity of the magnet 501. This will create zones along the magnet 501 that are not strong enough to hold the contacts of an electrical contact together. In embodiments where electrical contacts need to be held together to complete a circuit when the circuit breaks an alarm is triggered. When attached in parallel when only one electrical contact completes the circuit the alarm is not triggered.

In the shown embodiment there is an example magnetic field 606 shown by the dotted lines. The magnetic field 606 produced by the magnet 501 is not strong enough to close electrical contacts 601, 602, and 605. While the magnetic field 606 is strong enough to close electrical contacts 603, and 604. This will close the circuit activating the necessary items. In this configuration false positive readings will significantly be reduced because of misplaced electrical contacts within an electrical field.

Figure 8:
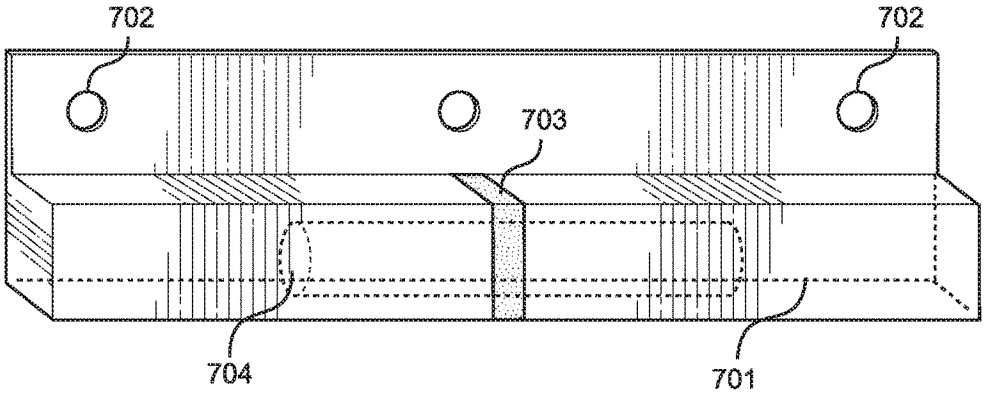
FIG. 8 shows a perspective view of an embodiment of an electrical contact activation device.

Referring now to FIG. 8, there is shown a perspective view of an embodiment of an electrical contact activation device. The electrical contact activation device is comprising of a housing 701 have a base and a plurality of walls. The housing 701 has an interior volume. The interior volume houses an activation device 704. In one embodiment the activation device 704 is a magnet.

The housing 701 has a plurality of apertures 702 located therethrough. The plurality of apertures 702 will allow the housing 701 to be secured to an item which corresponds with the circuit. In one embodiment the housing has a center marking 703 thereon. The center marking 703 marks the center of the activation device 704. When the center marking 703 is placed within the edge markers of the circuit housing the activation device will be properly positioned to activation the circuit. These markings will operate as failsafe indicators to allow an individual to ensure proper placement of the circuit and the electrical contact activation device. Using the markings will further reduce the size of the activation device 704 needed.

The electrical contact activation device housing 701 further allows for the device to be placed closer to the circuit board. This creates a smaller gap between the activation device and the circuit board. This greatly reduces the ability for an individual to be able to circumvent the system by placing a second activation device between the system's activation device and the reed switches.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An improved electrical contact system, comprising:
- a circuit board having two traces located along opposing edges of the circuit board;
- each trace having a plurality of lands attached thereto;
- a plurality of electrical contacts electrically connected to the lands, wherein the electrical contacts are part of a plurality of reed switches;
- wherein a first end of each reed switch is disposed on one of the two traces, and a second end of each reed switch is disposed on an opposing trace of the two traces;
- wherein the plurality of reed switches is disposed along a length of the circuit board; and
- wherein the first end of each reed switch is disposed between the first end and the second end of an adjacent reed switch, such that the plurality of reed switches overlaps.

2. The improved electrical contact system of claim 1, further comprising a housing, wherein the housing has an interior volume configured to house the circuit board.

3. The improved electrical contact system of claim 2, further comprising an electrical contact activation device, wherein the electrical contact activation device is located adjacent to the housing.

4. The improved electrical contact system of claim 3, wherein the electrical contact activation device is a magnet.

5. The improved electrical contact system of claim 1, wherein there are 5 electrical contacts.

6. The improved electrical contact system of claim 1, wherein the electrical contacts are attached in a series circuit.

7. The improved electrical contact system of claim 1, wherein the electrical contacts are attached in a parallel circuit.

8. An improved electrical contact system for a sensor, comprising:
- a circuit board having at least two traces located along opposing edges of the circuit board;
- each trace having a plurality of lands attached thereto;
- a plurality of electrical contacts electrically connected to the lands, wherein the electrical contacts are part of a plurality of reed switches;
- the circuit board located within a housing wherein the housing has a top and a plurality of sidewalls;
- wherein a first end of each reed switch is disposed on one of the two traces, and a second end of each reed switch is disposed on an opposing trace of the two traces;
- wherein the plurality of reed switches is disposed along a length of the circuit board; and
- wherein the first end of each reed switch is disposed between the first end and the second end of an adjacent reed switch, such that the plurality of reed switches overlaps.

9. The improved electrical contact system of claim 8, further comprising an electrical contact activation device, wherein the electrical contact activation device is located adjacent to the housing.

10. The improved electrical contact system of claim 9, wherein the electrical contact activation device is a magnet.

11. The improved electrical contact system of claim 8, wherein there are 5 electrical contacts.

12. The improved electrical contact system of claim 8, wherein the electrical contacts are attached in a series circuit.

13. The improved electrical contact system of claim 8, wherein the electrical contacts are attached in a parallel circuit.

14. The improved electrical contact system of claim 2, wherein the housing has a light on the exterior thereof;

wherein the light illuminates when the circuit is disrupted.

15. The improved electrical contact system of claim 8, wherein the housing has a light on the exterior thereof;

wherein the light illuminates when the circuit is disrupted.

16. The improved electrical contact system of claim 1, wherein each trace comprises a plurality of legs extending perpendicularly therefrom, wherein a land of the plurality of lands is disposed on a distal end of each of the plurality of legs.

17. The improved electrical contact system of claim 2, wherein the housing further comprises a pair of edge markers disposed on a top face of the housing, wherein the pair of edge markers extend along at least one sidewall of the housing.

18. The improved electrical contact system of claim 3, wherein the electrical contact activation device is disposed within a second housing, wherein the second housing includes a center marking thereon indicating the center of the electrical contact activation device within the second housing.

19. The improved electrical contact system of claim 2, wherein the housing includes a circuit board hole on a first end of the housing, the circuit board hole dimensioned to receive the circuit board therein.

20. The improved electrical contact system of claim 19, further comprising a pair of securement apertures disposed within the circuit board hole, wherein the securement apertures receive epoxy therein to secure the circuit board within the housing.

* * * * *